US005419441A

United States Patent [19]

Hirsch

[11] Patent Number: 5,419,441

[45] Date of Patent: May 30, 1995

[54] NEEDLE BLANK SORTING APPARATUS

[75] Inventor: Ronald A. Hirsch, Shelton, Conn.

[73] Assignee: United States Surgical Corporation, Norwalk, Conn.

[21] Appl. No.: 134,157

[22] Filed: Oct. 8, 1993

[51] Int. Cl.[6] ..... B07C 5/34

[52] U.S. Cl. ..... 209/587; 209/598; 209/939

[58] Field of Search ..... 209/653, 576, 587, 939, 209/552, 598, 586, 539, 908, 909, 920; 198/395, 396, 391, 370, 372; 382/8

[56] References Cited

U.S. PATENT DOCUMENTS

| | | | |
|---|---|---|---|
| 1,808,301 | 6/1931 | Ferguson et al. | 209/653 X |
| 1,919,434 | 7/1933 | Hutchinson | 209/653 X |
| 2,152,758 | 4/1939 | Cox | 209/653 X |
| 2,690,258 | 9/1954 | Cox | 209/653 X |
| 3,038,607 | 6/1962 | Eckert, Jr. | 209/587 X |
| 3,233,719 | 2/1966 | Engel | 209/653 X |
| 3,394,584 | 7/1968 | Mayer | 209/598 X |
| 3,489,277 | 1/1970 | Silverman | 209/653 X |
| 3,709,328 | 1/1973 | Mohr et al. | 209/598 X |
| 3,729,636 | 4/1973 | Merker . | |
| 3,804,270 | 4/1974 | Michaud et al. | 209/939 X |
| 3,980,567 | 9/1976 | Benini . | |
| 4,098,408 | 7/1978 | Miller, Jr. et al. | 209/653 X |
| 4,445,520 | 5/1984 | Knight et al. . | |
| 4,610,359 | 9/1986 | Müller . | |
| 4,655,350 | 4/1987 | Mojden et al. . | |
| 4,869,813 | 9/1989 | Bailey et al. | 209/939 X |
| 4,907,701 | 3/1990 | Kobayashi et al. | 209/939 X |
| 4,969,746 | 11/1990 | McConnell et al. . | |
| 5,000,323 | 3/1991 | Cahill et al. . | |
| 5,127,737 | 7/1992 | Neri . | |
| 5,311,977 | 5/1994 | Dean et al. | 198/395 |

FOREIGN PATENT DOCUMENTS

| | | | |
|---|---|---|---|
| 3141276 | 8/1982 | Germany . | |
| 3205189 | 8/1983 | Germany | 209/939 |

*Primary Examiner*—D. Glenn Dayoan

[57] ABSTRACT

The present invention relates to an apparatus and method for sorting needle blanks. Generally, the apparatus includes a needle transferring assembly which receives needle blanks at a needle loading position and sequentially transfers the needle blanks to a needle identifying position and to a needle sorting position. An imaging assembly has a focus aligned with the needle identifying position so as to identify whether an end face of the needle blank has a solid or hollow cross-section. A needle blank sorting assembly is provided to operate when the needle blanks are transferred to the needle sorting position. The needle blank sorting assembly responds to the imaging assembly so as to sort the needle blanks with the hollow cross-section from the needle blanks with the solid cross-section.

21 Claims, 6 Drawing Sheets

NEEDLE BLANK SORTING APPARATUS

BACKGROUND OF THE INVENTION

1. Field of the Invention

The present invention relates to a needle blank sorting machine. More particularly, the present invention relates to a needle blank sorting machine which sequentially examines and sorts needle blanks according to their end face character.

2. Description of the Related Art

The production of needles involves many processes and different types of machinery in order to prepare quality needles from raw stock. These varying processes and machinery become more critical in the preparation of surgical needles where the environment of intended use is in humans or animals. Some of the processes involved in the production of surgical grade needles include, inter alia: straightening spooled wire stock; cutting needle blanks from the wire stock; providing a bore for receiving suture thread at one end of the blank; tapering or grinding points on the other end of the blank; flat pressing a portion of the needle barrel to facilitate easier grasping by surgical instrumentation; and curving the blanks where curved surgical needles are desired. Conventional needle processing is, in large part, a labor intensive operation requiring highly skilled labor wherein extreme care must be taken to ensure that only the intended working of the needle is performed and the other parts of the needle remain undisturbed.

The present invention relates to a highly cost efficient apparatus and method for sorting needle blanks so that the end face of the blanks are oriented in the same direction after a bore has been created in one end face of the blank.

SUMMARY OF THE INVENTION

The present invention relates to an apparatus and method for sorting needle blanks. The apparatus includes means for transferring needle blanks between a needle loading position and a needle identifying position, means aligned with the needle identifying position for identifying the orientation of the needle blanks with respect to the needle transferring means and sorting means associated with the identifying means for sorting needle blanks in response to the identified orientation. The apparatus of the present invention may also include means for feeding a plurality of needle blanks to the needle transferring means. Preferably, the orientation of the needle blanks is defined between needle blanks having a solid cross-section in an end face thereof facing a first direction and needle blanks having a hollow cross-section in an end face thereof facing a second direction so that the needle blanks are sorted by their cross-sectional characteristics at one end face thereof.

Generally, the transferring means of the invention comprises a rotatable member having means, such as recesses, on an outer surface portion thereof to transfer needle blanks between the needle loading position and at least one of the needle identifying position and a needle sorting position.

The needle blank identifying means according to the present invention comprises imaging means for acquiring an image of the end face of the needle blanks and for comparing the acquired image to predetermined parameters to determine if the end face of the needle blank so imaged has either the solid cross-section or the hollow cross-section. Preferably, the imaging means is a video camera.

In one embodiment, the sorting means of the present invention includes at least one storage member for storing the sorted needle blanks. In another embodiment, the sorting means comprises a first storage member configured to receive and store needle blanks having the solid cross-section in an end face thereof facing the first direction, and a second storage member configured to receive and store needle blanks having the hollow cross-section in an end face thereof facing the second direction. A first sorting member is aligned with at least a portion of the needle blank transferring means and is responsive to the needle blank identifying means such that the first sorting member facilitates movement of needle blanks having the solid cross-section end facing the second direction into the first storage member. A second sorting member is aligned with at least a portion of the needle blank transferring means and is responsive to the needle blank identifying means such that the second sorting member facilitates movement of needle blanks having the hollow cross-section end facing the first direction into the second storage member.

Preferably, each of the first and second storage member include a cascade type cartridge and a guide member for receiving the needle blanks from the needle blank transferring means to guide the needle blanks to the cascade type cartridge. Further, each sorting member includes a pusher arm which pushes the needle blanks at least partially into either the first or second guide member to facilitate transportation of the needle blanks to the respective storage member.

An exemplary embodiment for the needle blank feeding means of the invention includes, a vibratory container configured to transfer needle blanks from a base of the container to a needle guide rail connected to a side wall of the container. The guide rail extends between the container and the needle blank transferring means and is configured to sequentially present the needle blanks thereto.

In an alternative embodiment, the apparatus for sorting needle blanks according to the present invention includes, imaging means for acquiring an image of an end face of a needle blank and means for positioning the end face of the needle blank adjacent the imaging means. Control means is provided to receive the image of the end face of the needle blank and to compare the received image to predetermined characteristics so as to determine whether the end face of the needle blank so imaged has a bore therein. Means associated with the control means is provided to group the needle blanks between needle blanks with a bore detected in the end face thereof and needle blanks without a bore detected in the end face thereof.

The present invention also relates to a method for sorting needle blanks which comprises loading a plurality of needle blanks onto needle transferring means, sequentially transferring the loaded needle blanks to a position for identifying and end face thereof, identifying whether the end face of the transferred needle blanks has a hollow cross-section or a solid cross-section, and sorting the identified needle blanks between needle blanks having the hollow cross-section and needle blanks having the solid cross-section.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
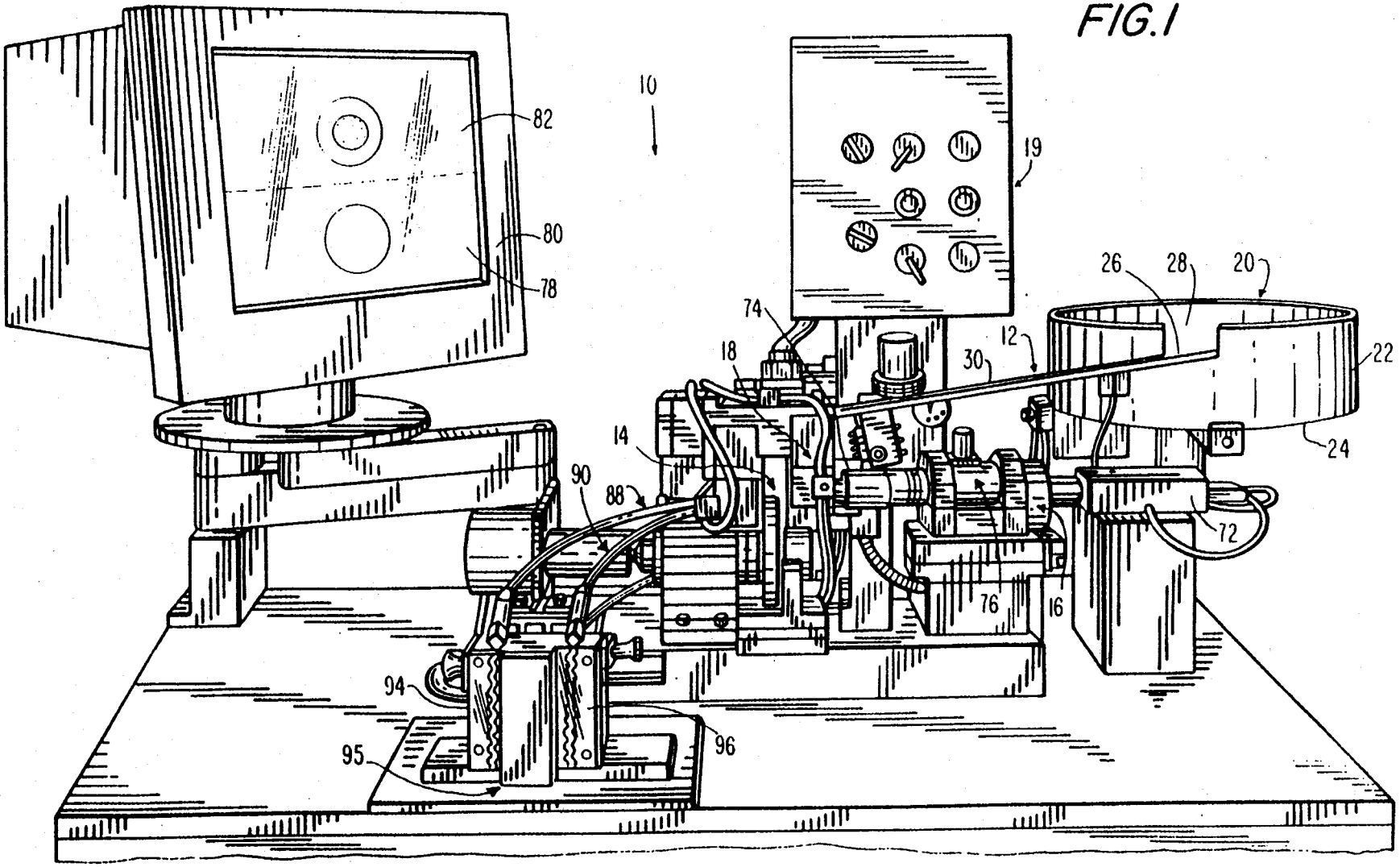
FIG. 1 is a perspective view of the needle blank sorting apparatus of the present invention.

Generally, as shown in FIG. 1, the needle blank sorting apparatus 10 of the present invention includes needle blank feeding assembly 12, needle blank transferring assembly 14, needle blank identifying assembly 16 and needle blank sorting assembly 18. Control unit 19 is associated with each assembly to coordinate positioning of the needle blanks, for proper detection of the end face of each needle and for proper sorting of the needle blanks. A suitable control unit for the present invention is the Automated Needle Inspection Video System, manufactured by Computer Technology, Inc., 99-01 Ascan Avenue, Forrest Hills, N.Y. 11375.

The needle blank feeding assembly 12 of the present invention is provided to retain a supply of needle blanks in a container, transfer the needle blanks to a cascade cartridge assembly 34 and to sequentially load the needle blanks onto needle blank positioning assembly 14. It can be seen that the cascade type cartridge assembly 34 includes a housing in which a serpentine or generally sinusoidal channel is provided for passage of relatively large quantities of needle blanks in a somewhat cascading fashion.

Referring again to FIG. 1, container 20 is preferably a vibratory bowl which includes a ramp positioned around the interior of side wall 22 of bowl 20 which extends in a spiral-like fashion from base 24 to needle presenting position 26. Typically, the needle presenting position is positioned at opening 28 of side wall 22. In this configuration, needle blanks deposited onto base 24 move along the ramp to needle presenting position 26.

Figure 2:
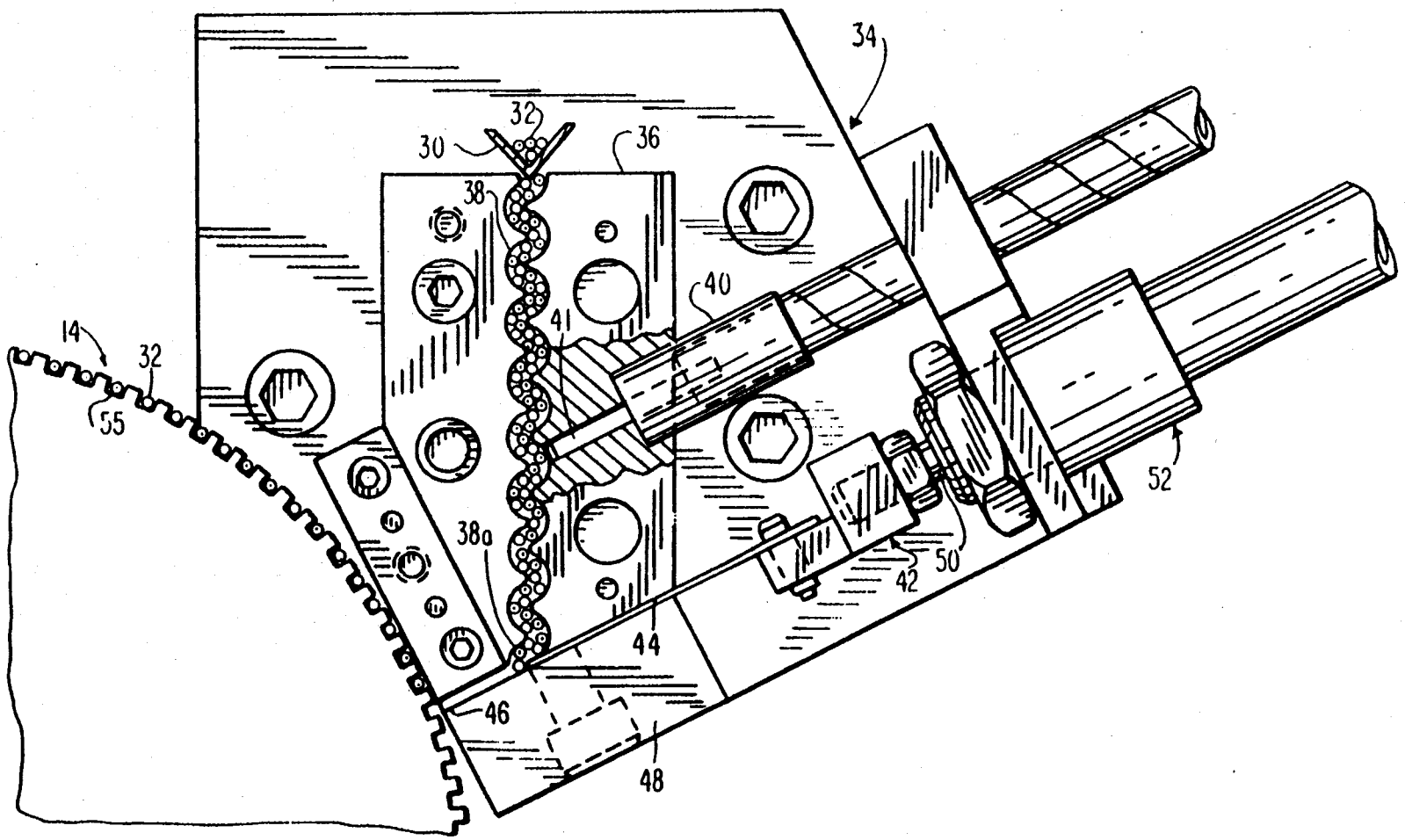
FIG. 2 is a side elevational view, greatly enlarged, of a portion of the needle feeding assembly of the apparatus of FIG. 1.

Referring to FIGS. 1 and 2, needle blanks 32 which have traversed the ramp within bowl 20 to the needle presenting position, slide along rail 30 into cascading cartridge assembly 34. As noted, cascade cartridge assembly 34 includes cascade type cartridge 36 which has a sinusoidal or serpentine channel 38 adapted to receive needle blanks 32 from rail 30. Proximity switch 40 is positioned within cartridge 36 so that the active portion 41 of the switch is located within channel 38 as shown. Proximity switch 40 is also connected to control unit 19 so that when switch 40 does not detect the presence of needle blanks, control unit 19 enables the transferring operation until switch 40 detects the presence of needle blanks. Thus, switch 40 is provided to ensure that a minimum number of needle blanks are loaded within the cascading cartridge. To assure a continuing flow of needle blanks within channel 38, a vibrating arm (not shown) may be connected to cascade type cartridge 36 to prevent needle blanks within channel 38 from jamming and inhibiting the flow of needle blanks to shutter assembly 42.

Figure 3:
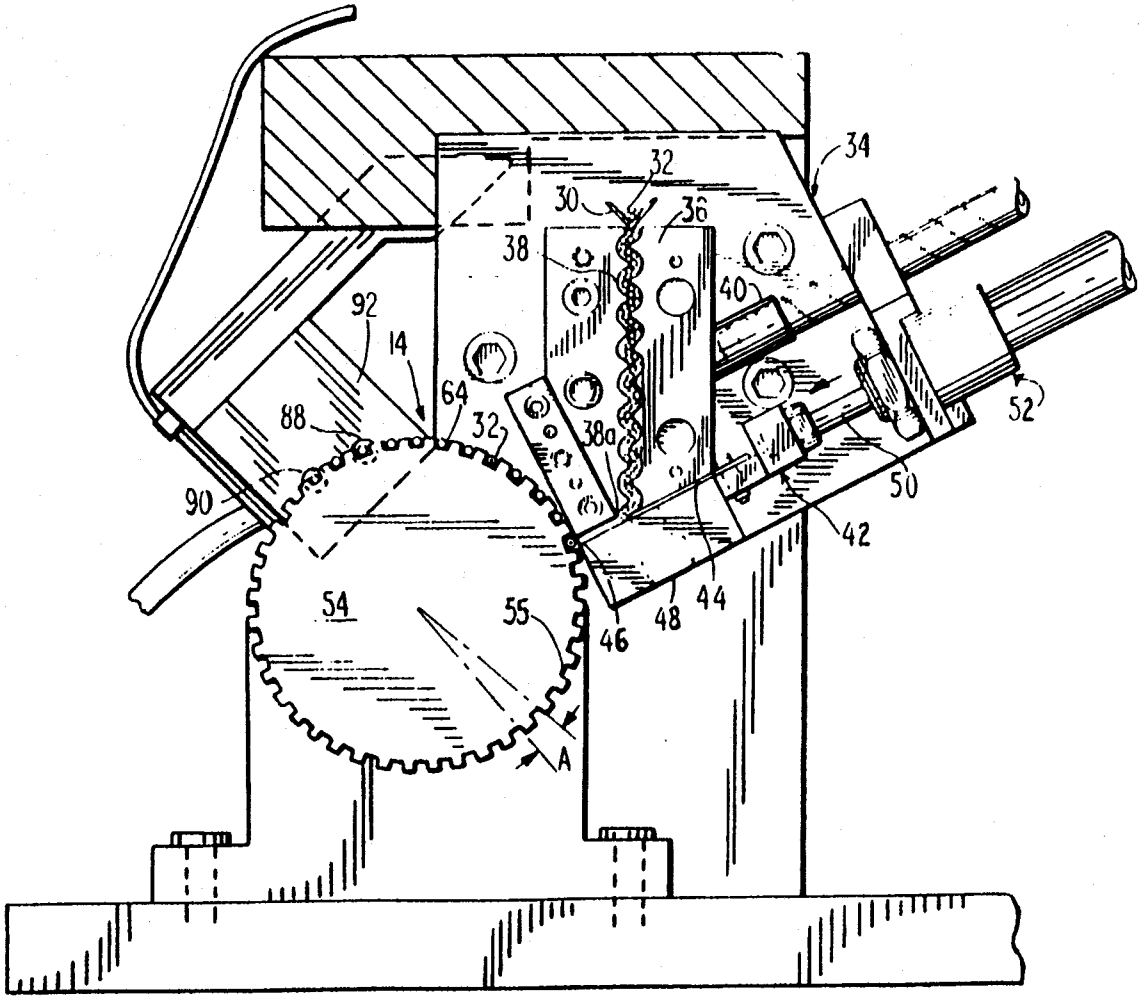
FIG. 3 is a side elevational view of the needle transferring assembly, a portion of the needle feeding assembly and a portion of the needle sorting assembly of the apparatus of FIG. 1.

Referring to FIGS. 2 and 3, shutter assembly 42 is secured to cartridge assembly 34 adjacent to lower portion 38*a* of channel 38. By this configuration, shutter arm 44 is permitted to slide between channel 38 and the needle loading position 46, as shown, so as to sequentially present needle blanks to needle blank transferring system 14. Shutter stop 48 is secured to cartridge assembly 34 adjacent to shutter arm 44 and is provided to limit the movement of shutter arm 44 so as to prevent marring of the needle blank when it is loaded onto transferring system 14, as shown. Shutter arm 44 is connected to piston 50 of pneumatic drive member 52 which facilitates reciprocal movement of the shutter arm between channel 38 and the needle loading position 46. Preferably, drive member 52 is connected to control unit 19 and is activated in a timed sequence which causes sequential loading of needle blanks 32 onto needle blank transferring assembly 14, as is described in more detail below.

Figure 4:
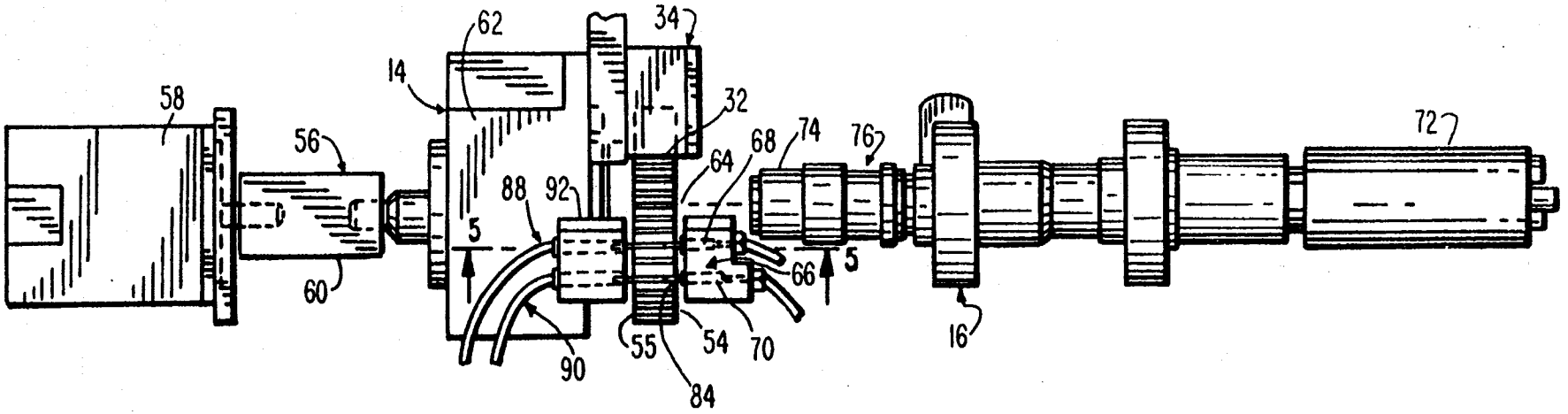
FIG. 4 is a top plan view of the video camera assembly, the needle transferring assembly and the needle sorting assembly of the invention.

Referring to FIG. 4 in conjunction with FIG. 3, the needle blank transferring assembly 14 of the present invention includes wheel 54 connected to drive assembly 56. Drive assembly 56 includes stepper motor 58, drive shaft 60 and bearing housing 62 which facilitates rotation of wheel 54 in predefined stepped increments. Wheel 54 has indentations or recesses 55 which are positioned around the outer surface of wheel 54 and adapted to receive the needle blank, as shown in FIGS. 2 and 3. In the preferred embodiment, indentations 55 are configured as a square shaped channel adapted to receive and maintain needle blanks therewithin.

As noted above, wheel 54 is rotated in predefined increments so that needle blanks are loaded into indentations 55 at needle loading position 46. Each rotational or step movement of wheel 54 corresponds to the spacing between indentations 55. In other words the step for the rotation of wheel 54 is substantially equivalent to angle "A", shown in FIG. 3. Thus, when wheel 54 is stepped or rotated, a new needle blank is loaded into the next indentation 55 on wheel 54. As noted, motor 58 is preferably a stepper motor which is operatively connected to control unit 19 and actuated therefrom so that each time the motor is stepped, the indentations 55 of wheel 54 are advanced so as to become respectively aligned with the loading position 46, the identifying position 64, and the sorting position 66. The identifying position and the sorting position will be described in greater detail hereinbelow.

Drive member 52 of shutter assembly 42 is coordinated with the rotation of wheel 54 by control unit 19 shown in FIG. 1. When a needle is loaded at needle loading position 46, wheel 54 is stepped, as noted, so as to transfer each needle blank loaded thereon to the needle identifying position 64 and onto the needle sorting position 64, shown in FIGS. 3 and 4.

The needle identifying position is defined as the position of the needle blank when it becomes aligned with the line of focus of lens assembly 76 of camera 72 of needle identifying assembly 16, as shown by the dashed lines in FIG. 4. In addition to transferring the needle blank to the needle identifying position, wheel 54 continues to step so that the needle blanks are transferred to the needle sorting position 66. The needle sorting position 66 is defined as the position of the needle blank when it becomes aligned with either first sorting member 68 or second sorting member 70 of needle sorting assembly 18, as shown in FIG. 4. At the needle sorting position the needle blanks are ejected from wheel 54 so that indentations 55 are empty after wheel 54 passes therethrough, as shown.

Referring again to FIGS. 1 and 4, the needle blank identifying assembly 16 of the present invention includes video camera 72, ring light 74 and lens assembly 76 which are configured to provide a clear image of the end face of each needle blank as they pass through the needle identifying position 64. Suitable components for the needle blank identifying assembly 16 include, a model XC-77 video camera, manufactured by SONY, a model 8603 ring light manufactured by Fostec, Inc., 273 Genesee Street, Auburn, N.Y., 13021, and a 10X lens assembly manufactured by Nikon.

Camera 72 transfers the acquired image to control unit 19 which displays the acquired image on monitor 80. For example, a representative exemplary acquired image 78 of a needle blank end face of solid cross-section is shown on monitor 80 in FIG. 1. Control unit 19 also displays predetermined characteristics of the end face of a needle blank, represented in FIG. 1 as image 82 on monitor 80. For example, image 82 is representative of a needle blank end face having a hollow cross-section. Displaying the images on monitor 80 permits visual examination of the needle blank end faces by an operator. The predetermined characteristics displayed on the monitor and utilized by control unit 19 represent a needle blank end face which has either a hollow cross-section or a solid cross-section. These cross-sectional characteristics are utilized as the comparison criteria for sorting the needle blanks. Therefore, control unit 19 compares the characteristics of the acquired image with the predetermined characteristics to determine whether the needle blank in the needle identifying position has a solid cross-section at the end face thereof, as shown in image 78 in FIG. 1, or whether the needle blank has a hollow cross-section at the end face thereof, as shown in image 82 in FIG. 1. Control unit 19 stores the compared information in memory for subsequent sorting as will be described in more detail below.

Figure 5:
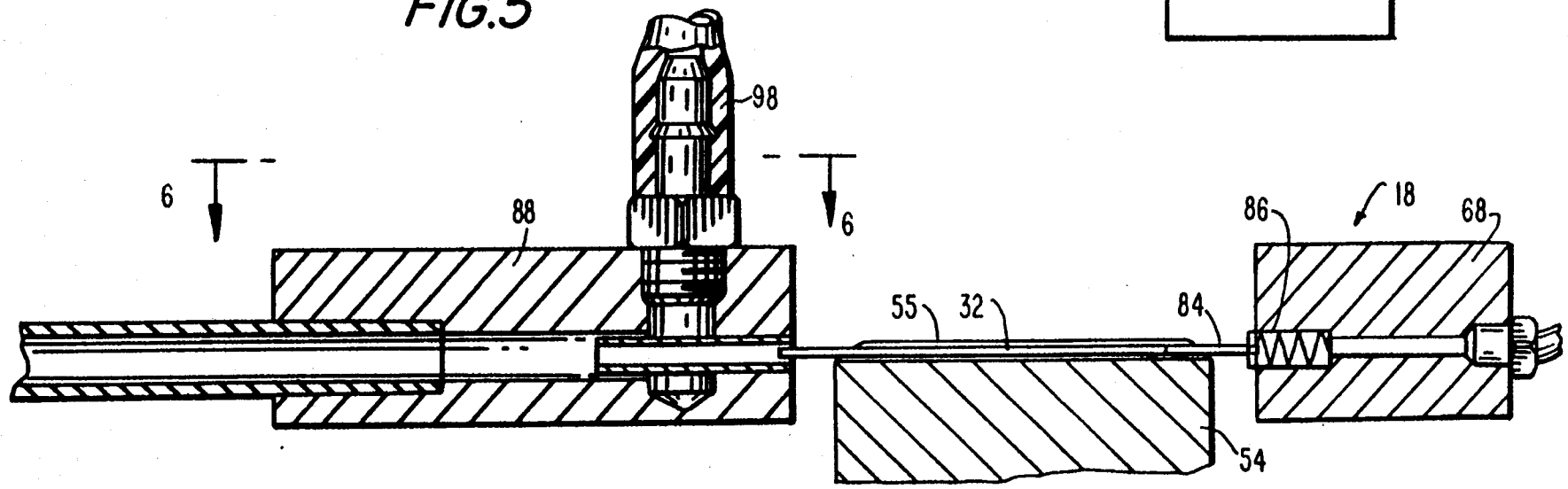
FIG. 5 is a partial cross-sectional view of a portion of the needle sorting assembly taken along line 5—5 of FIG. 4 and illustrating a needle pusher assembly and a needle guide assembly.

Referring to FIGS. 4–7, the needle sorting assembly 18 of the present invention includes a pair of needle sorting members 68 and 70 which define the needle sorting position as described above. Preferably, each needle sorting member, shown in detail in FIG. 5, includes a pusher arm 84 which ejects from or retracts into cylinder 86 in response to air pressure. Pusher arm 84 is configured to engage the end face of needle blank 32 and push the blank at least partially off wheel 54, as shown in FIG. 5.

Figure 6:
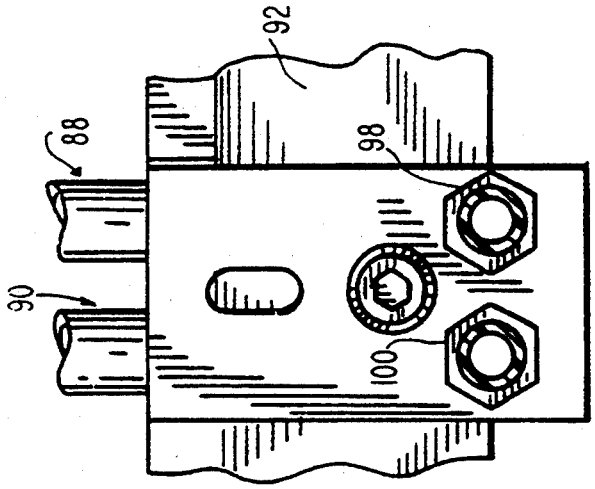
FIG. 6 is a view of the needle guide assembly taken along lines 6—6 of FIG. 5, illustrating the needle guide members.

Referring now to FIGS. 5 and 6, needle sorting assembly 18 also includes a pair of guide members 88 and 90, which are positioned adjacent wheel 54. The position of first guide member 88 corresponds to the sorting position associated with needle sorting member 68, as shown in FIG. 5. Similarly the position of second guide member 90 corresponds to the sorting position associated with needle sorting member 70.

Referring again to FIG. 1, in conjunction with FIGS. 5 and 6, guide members 88 and 90 extend from bracket 92 to first and second needle blank storage members 94 and 96 which are releasably secured to storage frame 95. A source of air pressure is provided to each guide member 88 and 90 at connectors 98 and 100 to facilitate movement of the sorted needle blanks along guide members 88 and 90 and into the respective storage member 94 and 96. Connector 98 is shown in FIGS. 5 and 6. In the view shown in FIG. 5, connector 100 is not shown but would be positioned in front of connector 98.

Figure 7:
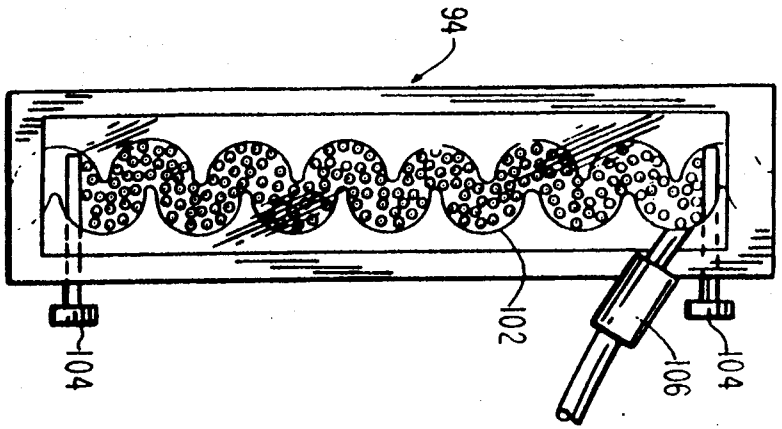
FIG. 7 is a front elevational view of an exemplary cascade type needle blank storage receptacle according to the present invention.

Referring now to FIG. 7, in the preferred embodiment, each storage member includes a winding channel 102 adapted to receive a plurality of needle blanks and a pair of retaining rods 104 which extend through channel 102 to prohibit needle blanks 32 from entering or exiting the channel. Blocking channel 102 with rods 104 facilitates easy insertion and removal of storage receptacle 94 for continuous operation of the sorting apparatus of the present invention. Preferably, proximity switch 106 is connected to control unit 19 and is secured to storage receptacle 94 or 96 so that the active portion thereof is directed to a top portion of the storage receptacle. Once channel 102 is filled with needle blanks 32 to a predetermined level defined by the positioning of the active portion of proximity switch 106, switch 106 activates to generate a control signal at control unit 19. Control unit 19 then deactivates the apparatus of the present invention until either a new storage receptacle is installed in frame 95 or until channel 102 is emptied by removing at least one rod 104.

In operation, the needle blanks 32 are deposited into vibratory bowl 20 and traverse the bowl and rail 30 until the blanks are loaded into cascading cartridge assembly 34. The needle blanks are then sequentially loaded onto wheel 54 of needle blank transferring system 14 for transfer to the needle identifying position. Each needle blank which passes through the needle identifying position is identified as having a hollow cross-section in the end face or as having a solid cross-section in the end face, by needle blank identifying assembly 14.

Once the end face is identified, each needle blank is transferred to the needle sorting position for subsequent sorting in response to control unit 19. As noted hereinabove, control unit 19 stores in memory the information resulting from the comparison of the predefined characteristics for the end face of a needle blank and each acquired image of the end face of each needle blank passing through needle identifying position 64. In addition, control unit 19 keeps track of the location of each needle blank on wheel 54 so as to selectively actuate the sorting member 68 or 70 which corresponds to the compared data. Actuation of the sorting member ejects the needle blank from wheel 54 and permits transfer of the needle blanks to a corresponding storage receptacle 94 or 96.

It will be understood that various modifications can be made to the embodiments of the present invention herein disclosed without departing from the spirit and scope thereof. For example, various sizes for the indentations on the wheel of the needle blank transferring assembly, to accommodate various sizes needle blanks is contemplated, as well as various types of construction materials which prevent marring of the needle blank. Also various modifications may be made in the configuration of the parts. Therefore, the above description should not be construed as limiting the invention but merely as exemplifications of preferred embodiments thereof. Those skilled in the art will envision other modifications within the scope and spirit of the present invention as defined by the claims appended hereto.

What is claimed is:

1. Apparatus for sorting needle blanks, which comprises:

means for transferring needle blanks between a needle loading position and a needle identifying position;

means aligned with said needle identifying position for identifying the orientation of the needle blanks with respect to said needle transferring means, wherein said orientation of the needle blanks is defined between needle blanks having a solid cross-section in an end face thereof facing a first direction and needle blanks having a hollow cross-section in an end face thereof facing a second direction; and sorting means associated with said identifying means for sorting needle blanks in response to said identified orientation.

2. The apparatus according to claim 1, wherein said transferring means comprises a rotatable member having means on an outer surface portion thereof to transfer needle blanks between said needle loading position and at least one of said needle identifying position and a needle sorting position.

3. The apparatus according to claim 1, wherein said needle blank identifying means comprises:

imaging means for acquiring an image of the end face of the needle blanks and for comparing said acquired image to predetermined parameters to determine if the end face of the needle blank so imaged has either said solid cross-section or said hollow cross-section.

4. The apparatus according to claim 3, wherein said imaging means comprises a video camera.

5. The apparatus according to claim 1, wherein said sorting means includes at least one storage member for storing the sorted needle blanks.

6. The apparatus according to claim 1, wherein said sorting means sorts the needle blanks between needle blanks having the solid cross-section in an end face thereof facing a first direction and needle blanks having the hollow cross-section in an end face thereof facing a second direction.

7. The apparatus according to claim 6, wherein said sorting means comprises:

a first storage member configured to receive and store needle blanks having the solid cross-section in an end face thereof facing said first direction;

a second storage member configured to receive and store needle blanks having the hollow cross-section in an end face thereof facing said second direction;

a first sorting member aligned with at least a portion of said needle blank transferring means and responsive to said needle blank identifying means such that said first sorting member facilitates movement of needle blanks having the solid cross-section end facing said second direction into said first storage member; and a second sorting member aligned with at least a portion of said needle blank transferring means and responsive to said needle blank identifying means such that said second sorting member facilitates movement of needle blanks having the hollow cross-section end facing said first direction into said second storage member.

8. The apparatus according to claim 7, wherein each of said first and second storage members comprises a cascade type cartridge and a guide member for receiving the needle blanks from said needle blank transferring means and guiding the needle blanks to said cascade type cartridge.

9. The apparatus according to claim 7, wherein each said first and second sorting members comprises a pusher arm which pushes the needle blanks at least partially into either said first or second storage members.

10. The apparatus according to claim 1, further comprising means for feeding needle blanks to said needle blank transferring means.

11. The apparatus according to claim 10, wherein said needle blank feeding means comprises a vibratory container configured to transfer needle blanks from a base of said container to a needle guide rail connected to a side wall of said container, said guide rail extending between said container and said needle blank transferring means and configured to sequentially present the needle blanks thereto.

12. The apparatus according to claim 2, wherein said means on said outer surface portion of said needle blank transferring means to transfer needle blanks comprises a plurality of recesses.

13. The apparatus according to claim 1, wherein said means for transferring comprises a rotating member adapted to releasably maintain a plurality of needle blanks and to sequentially transfer the needle blanks from a needle loading position to a needle identifying position and to a needle sorting position;

said means aligned with said needle identifying position identifies needle blanks having a hollow cross-section in an end face thereof facing a first direction and needle blanks having a solid cross-section in the end face thereof facing a second direction; and said sorting means comprises a sorting member associated with said identifying means and adapted to sort needle blanks at said needle sorting position between needle blanks having said hollow cross-section in an end face thereof facing said first direction and needle blanks having said solid cross-section in the end face thereof facing said second direction.

14. The apparatus according to claim 13, wherein said rotating member includes a plurality of recesses positioned along an outer surface thereof to transfer the needle blanks between said needle loading position, said needle identifying position and said needle sorting position.

15. The apparatus according to claim 13, wherein said needle blank identifying means comprises:

imaging means for acquiring an image of the end face of the needle blanks and for comparing said acquired image to predetermined parameters to determine if the end face of the needle blank has either said solid cross-section or said hollow cross-section.

16. The apparatus according to claim 13, wherein said sorting member comprises first and second pusher members aligned with said needle sorting position and adapted to selectively engage said needle blanks so as to eject at least a portion of said needle blanks from said rotating member.

17. The apparatus according to claim 16, wherein said sorting member further comprises first and second guide members aligned with said needle sorting position, said first guide member being adapted to receive at least said portion of said needle blanks ejected by said first pusher member and said second guide member being adapted to receive at least said portion of said needle blanks ejected by said second pusher member.

18. The apparatus according to claim 17, wherein said sorting member further comprises a first storage receptacle associated with said first guide member and adapted to receive needle blanks therefrom, and a second storage receptacle associated with said second guide member and adapted to receive needle blanks therefrom.

19. The apparatus according to claim 16, wherein said sorting member includes at least one storage receptacle adapted to store the sorted needle blanks.

20. Apparatus for sorting needle blanks, which comprises:

imaging means for acquiring an image of an end face of a needle blank;

means for positioning the end face of the needle blank adjacent said imaging means;

control means for receiving said image of the end face of the needle blank and comparing said received image to predetermined characteristics to determine whether the end face of the needle blank so imaged has a bore therein; and means associated with said control means for grouping the needle blanks between needle blanks with a bore detected in the end face thereof and needle blanks without a bore detected in the end face thereof.

21. A method for sorting needle blanks comprising:

loading a plurality of needle blanks onto needle transferring means;

sequentially transferring said loaded needle blanks to a position for identifying an end face thereof;

identifying whether said end face of said transferred needle blanks has a hollow cross-section or a solid cross-section; and sorting said identified needle blanks between needle blanks having said hollow cross-section and needle blanks having said solid cross-section.

* * * * *